US005404686A

United States Patent [19]

Esposito

[11] Patent Number: 5,404,686

[45] Date of Patent: Apr. 11, 1995

[54] CONSTRUCTION ARRANGEMENT INCLUDING MULTIPLE PANELS PROVIDED WITH INTERLOCKING EDGES AND RELATED METHODS

[76] Inventor: Chris Esposito, 5005 Veterans Mem. Hwy., Holbrook, N.Y. 11741

[21] Appl. No.: 204,731

[22] Filed: Mar. 2, 1994

Related U.S. Application Data

[63] Continuation of Ser. No. 881,483, May 11, 1992, Pat. No. 5,363,606.

[51] Int. Cl.[6] ..... E04B 2/72; E04C 2/34

[52] U.S. Cl. ..... 52/588.1; 52/309.9; 52/309.14; 52/592.1

[58] Field of Search ..... 52/578, 579, 588.1, 52/589.1, 591.1, 591.3, 592.1, 592.2, 592.4, 309.9, 309.14

[56] References Cited

U.S. PATENT DOCUMENTS

| | | | |
|---|---|---|---|
| 3,760,548 | 9/1973 | Sauer et al. | 52/592.1 |
| 4,438,614 | 3/1984 | Raith et al. | 52/592.1 |
| 4,769,963 | 9/1988 | Meyerson | 52/588.1 |
| 4,998,396 | 3/1991 | Palmersten | 52/588.1 |
| 5,086,599 | 2/1992 | Meyerson | 52/588.1 |
| 5,092,095 | 3/1992 | Zadok et al. | 52/588.1 |
| 5,138,812 | 8/1992 | Palmersten | 52/588.1 |
| 5,293,728 | 3/1994 | Christopher et al. | 52/588.1 |

FOREIGN PATENT DOCUMENTS

| | | | |
|---|---|---|---|
| 2168732 | 6/1986 | United Kingdom | 52/588.1 |

*Primary Examiner*—Michael Safavi

*Attorney, Agent, or Firm*—Ladas & Parry

[57] ABSTRACT

A construction is provided in the form of a roof or a wall or the like which includes a plurality of parallel panels connected in series. These panels include juxtaposed edge portions and are formed of cores provided with skins which extend along the cores and beyond the same to form interlocking members to connect the parallel panels together. Some of the interlocking members may be in the form of ramps which are resiliently supported. The interlocking members which engage therewith are in the form of hook-shaped members which ride up the ramps and beyond the same. The interlocking members which are formed as ramps define a rectilinearily shaped receptacle for receiving the core of the next adjacent panel. The received core extends into the receptacle short of the core associated therewith. The interlocking members bear upon one another and selective of the associated cores in order to enhance the load bearing characteristics of the construction. Some of the interlocking members also form fluid evacuating passages extending longitudinally along the panels. A gutter arrangement can be provided at the extremities of the panels in order to receive and drain away fluid received from the aforesaid passages. The received core can be formed with a tongue which may be integral with the associated core or separate from but cemented thereto. The tongue can be chamfered to permit tilting of the panels when they are brought together. Alternatively, the panels can be brought directly together in edge-to-edge direction or can be connected by relative longitudinal displacements.

14 Claims, 8 Drawing Sheets

CONSTRUCTION ARRANGEMENT INCLUDING MULTIPLE PANELS PROVIDED WITH INTERLOCKING EDGES AND RELATED METHODS

This application is a continuation of application Ser. No. 07/881,483, filed May 11, 1992, now U.S. Pat. No. 5,363,606.

FIELD OF INVENTION

This invention relates to constructions for the erecting of, for example, side and overhead portions of structures and more particularly to panels provided with interlocking edges. The invention also relates to associated methods.

PRIOR ART

Different structures formed of multiple panels are known and have been shown in various U.S. Patents such as U.S. Pat. Nos. 2,682,938; 3,367,076; 3,479,784; 3,742,672; 3,760,548; 4,186,539; 4,373,312, and 4,769,963.

S. Meyerson discloses in U.S. Pat. No. 4,769,963 a building panel formed from two sheets of thin metal bonded to a foamed core. One longitudinal edge of the panel has a first pair of shaped interlocking elements with a shaped-wedge portion of a core projecting outwardly between this first pair of elements. A second and opposite edge of the panel has a second pair of interlocking elements with a cup-like edge of the core conforming to the wedge at the opposite side and associated with a second pair of U-shaped interlocking elements. Adjacent panels are snapped together by moving the same in relatively edge-to-edge direction such as to bring the interlocking elements over the ramp and into the groove of the first pair of interlocking elements to form an edge-to-edge seal. It will be particularly noted that the cores are formed at their adjoining edges as receptacles and as projections which are received in these receptacles.

In U.S. Pat. No. 2,682,938, A. MacDonald discloses a metal plank in which installation of adjacent planks takes place as in the Meyerson construction. At the edges of adjacent planks there are provided male and female members which may be engaged by bringing the panels together in edge-to-edge direction.

P. O'Brien discloses in U.S. Pat. No. 3,367,076 a complicated arrangement of interlocking elements. These elements require the bringing of panels together in edge-to-edge abutting relationship in a manner which is subject to various disadvantages.

In U.S. Pat. No. 3,479,784, D. Massagli shows an arrangement which permits installation by transverse relative displacement of adjacent panels. One panel must be tilted into position relative to another which under various circumstances is rather disadvantageous.

H. Schaeufele reveals a building panel in U.S. Pat. No. 3,742,672 which is useful for modular construction. A plurality of such panels are assembled in edgewise abutting relationship to form a structural barrier such as a wall. The interlocking elements disclosed in this patent are subject to various disadvantages which it is an object of the present invention to avoid.

G. Sauer in U.S. Pat. No. 3,760,548 shows a modular panel relationship unlike that to be disclosed below as does W. Harmon in U.S. Pat. No. 4,186,539.

In U.S. Pat. No. 4,373,312, K. Kim reveals a structure utilizing roof panels including interior and exterior corrugated sheets disposed on opposite faces of a foam core. Self drilling threaded fasteners are employed requiring steps and hardware which are different from what is contemplated within the scope of the present invention.

In British Patent 1,066,701 is shown cooperating panels having mating male and female members at opposite extremities thereof. French Patent 2,444,762 reveals panels which are unlike those which will be sent forth herein.

Various U.S. Patents disclose panels which are engaged by virtue of some type of transverse motion. These patents include U.S. Pat. Nos. 2,783,507; 2,739,677; 2,838,144, and 4,091,588.

SUMMARY OF INVENTION

An object of the invention is to provide improved panel construction systems relative to the prior art patents mentioned hereinabove.

A further object of the invention is to provide an improved interlocking arrangement for panels employed in roofs, walls and the like.

Another object of the invention is to provide an improved interlocking or interengagement system in which a series of panels may be aligned in parallel and edgewise abutting relationship with one another.

Still another object of the invention is to provide an improved panel arrangement having superior thermal insulation qualities.

It is yet another object of the invention to provide an improved panel arrangement having novel arrangements for drainage.

In achieving the above and other objects of the invention in accordance with one aspect thereof, there is provided a construction comprising at least two adjacent panels including respective cores with skins being provided on these cores. These panels have respective edge portions proximate one another. Each portion includes a pair of longitudinal edges in the shape of interlocking members which are interengageable to hold the panels together. The core of one of the panels includes an extension and the interlocking members of the other end of the panels are spaced from one another and define a receptacle to receive and hold the extension preferably short of penetration into the core of the other panel.

In the aforesaid arrangement, the panels are elongated parallel members and the extension and receptacle extend longitudinally relative thereto. According to one embodiment, the locking members of the other panels each define a receptacle with flat parallel sides, the extensions each having flat parallel sides for sliding insertion into the receptacles. The penetration of each extension into the core of the associated panel is prevented by engagement of the interlocking members such that the extension is held in spaced relationship to the core of said other panel. It should be noted that the panels include flat faces parallel to the aforementioned sides.

In accordance with other embodiments, the extensions have chamfered edges, enabling the panels to be brought together in angularly related positions whereafter the panels can be brought to a common planar relationship.

In accordance with another aspect of the invention, a construction is provided which comprises first and second adjacent panels including proximate edge portions. The panels include respective cores with skins being provided on these cores as aforesaid. The skins include a first arrangement at the edge portion to hold adjacent panels together and a second arrangement is associated with the cores to enhance the fire resistant qualities thereof.

In the aforesaid arrangement, the item which enhances the fire resistant qualities of the cores includes sheets of fire resistant material sandwiching the cores. The fire resistant item may also be constituted by sheets of fire resistant material which are embedded in the cores. The sheets of fire resistant material may be arranged in such a manner as to constitute interlocking arrangements themselves.

In accordance with yet another aspect of the invention there is provided a construction consisting of first and second panels having first and second faces and including facing edge portions with pairs of interengaged locking arrangements being provided on the panels at the edge portions and at respective of the faces. One of the interengaged locking arrangements of each pair may include a first section extending along the corresponding edge portion of the associated panel and a second section extending from the first section in cantilever relationship thereto. A sloped cantilever arm section may be provided extending angularly from the cantilever section and a lip may be provided which extends from the cantilever arm in substantially spaced parallel relationship with the first mentioned section. The other of the engaged interlocking arrangements of each pair include a first part aligned in parallel with the cantilever section, a second part extending orthogonally from the first part in parallel to the first section mentioned above and a third part extending orthogonally from the second part in spaced parallel relationship to the first part. The first, second and third parts constitute a first J-shaped structure. A lip extends therefrom in spaced parallel relationship with the aforementioned second part. This lip and the second part as well as the third part constitute a further J-shaped structure. A sealing arrangement such as a silicone sealant may be arranged, for example, between the first section and second part to seal the interengaged locking arrangement hydraulically.

Another manner in which to view the invention is as a structure including as aforesaid a plurality of parallel panels connected in series with locking means extending along edge portions of these panels and connecting the panels together. In this arrangement, the locking arrangements define channels for fluid evacuation and a gutter is mounted on adjacent ends of the panels by means of flanges. The gutter defines a passage at the ends to receive fluid evacuated by the aforementioned channels. At least one of the flanges connecting the gutter to the ends is provided with openings for the removal of fluid found in the passage.

In general, the invention may be regarded as providing a structure which includes a plurality of panels preferably defining a common plane and including coplanar cores and pairs of skins thereon including interlocking elements. One of the pairs of interlocking elements on each of the panels defines a receptacle for receiving the core on the next adjacent of the panels as will all be explained hereinafter.

According to still other aspects of the invention, provision is made for bringing panels together with edge-to-edge displacements either directly or angularly or with relative longitudinal displacement. As will be shown, C-shaped receptacles or the like can be employed to hold the panels against a supporting structure into which the panels may be slid as a unit or individually.

As a feature of the invention, the cores with their extensions can be fabricated monolithically or the extensions can be fabricated separately and then affixed to the cores. The latter technique is advantageously economical and convenient.

The above and other objects, features and advantages of the invention will be apparent from the following detailed description of some preferred embodiments as illustrated in the accompanying drawing.

BRIEF DESCRIPTION OF DRAWING

In the drawing:

FIG. 1 is a diagrammatical plan view illustrating a plurality of panels connected in parallel to form a structure such as a roof or wall or the like;

DETAILED DESCRIPTION

Figure 1:
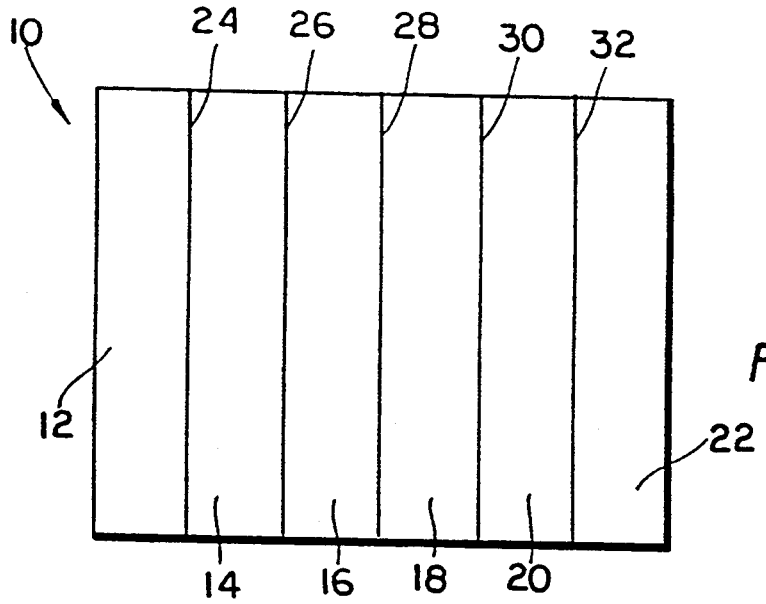

In accordance with the invention, a roof or wall panel assembly or the like is provided that can support irregular roof or wall loads on adjoining panels without having the panels assume a misaligned relationship or becoming deformed. If, for example, distortion might result from the fact that heavier loads are placed on one panel than on the next adjacent panel, arrangements of the invention are useful for supporting the panels by a plurality of bearing arrangements which are effective from the use of interlocking elements which are provided in accordance with the invention. This, as will be seen, provides a multiple zone support of the outer metal skin of the cores and this, in turn, provides for avoiding the result that silicone caulk seals which are employed might be broken.

According to another aspect of the invention, a panel assembly is provided which can be caulked for purposes of providing a water-proof seal and which provides for water removal while avoiding leakage or water damage to the interior core. A silicone seal may be provided on select surfaces, as will be indicated below, joining the panels together. Once joined, the outer metal skins of the various cores provide water drainage passages or cavities which carry away any seepage or condensation to the ends of the panels while keeping the water from damaging the inner core or the bonding agent holding the inner core and the metal skins together. This prevents delamination of the panels.

In yet another aspect of the invention, there is provided a panel assembly with improved double-spring action characteristics providing improved interlocking ability. This in turn provides for maximum interlocking engagement with minimum effort beings needed to engage or join the panels together. This double-spring action is achieved by inward deflection of various of the elements and outward deflection of various other of the elements as the panels are joined together upon full engagement. As will be shown, after initial deflection, certain of the interlocking elements spring back to their original positions and become seated in pockets forming a deep interlock which resists being pulled apart.

As will be described below, there is further provided a panel assembly with a triple engagement for maximum strength, stability and weather proofing as well as air infiltration protection. The various elements which engage with one another will be described in greater detail below.

According to still another aspect of the invention, a panel assembly system is provided that is easy to fabricate and which lends itself to a moisture-protected multi-layered core arrangement in which fire-rated sheetrock layers may be utilized in order to meet fire-rating requirements for various building codes. The sheetrock is prevented from being damaged by moisture by the utilization of the drainage passages mentioned hereinabove which completely contain the moisture in metal skins and which drain off the moisture at the ends of the panels. According to one particular embodiment, as will be shown hereinafter, the protruding edge of each sheetrock element is protected from damage by the related metal channels which, at the same time, provide a means for further interengaging the panels.

Referring next to FIG. 1, there is illustrated therein a construction element 10 which may be part or all of, for example, a roof or wall structure. This constructional element consists of multiple elongated parallel panels, preferably flat, such as indicated by way of example at 12, 14, 16, 18, 20 and 22. The illustrated panels have, for example, abutting edges at which interlocking takes place. These abutting edges are illustrated by way of example at 24, 26, 28, 30 and 32. The details of this interlocking arrangement are discussed in greater detail below with reference to FIGS. 2 and 3.

Figure 2:
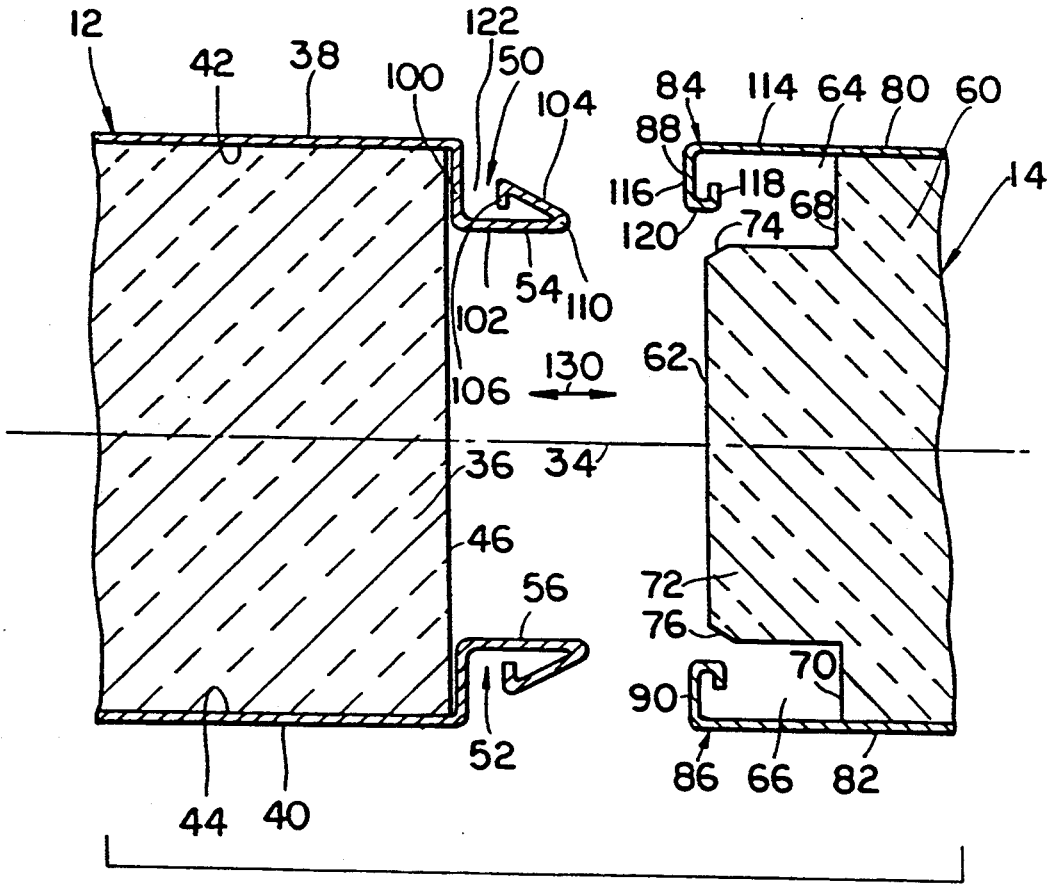
FIG. 2 is a fragmentary view of adjoining panels including an interlocking structure provided in accordance with the invention.

In FIG. 2 is illustrated, by way of example, the abutting edges of panels 12 and 14 before these panels have been brought together. As mentioned hereinabove, the panels are flat elongated panels. They are, in the preferred arrangement, coplanar and cooperatively define a plane of symmetry indicated at 34. The panel 12 is, for example, fabricated of a core 36 having bonded thereto skins 38 and 40. The core 36 is of rectangular cross section and is bonded to the skins 38 and 40 at contacting surfaces 42 and 44. The core 36, as are the other cores of the assembly, is preferably formed of a foamed material such as, for example, polyurethane or the like. Core 36 has, moreover, a flat end or edge face indicated at 46. The skins 38 and 40 may be fabricated preferably of metal such as, for example, rolled steel or aluminum of any thickness and strength.

The ends of the skins at the lateral edges of the panel form, in protruding beyond the edges of the core 36, interlocking elements 50 and 52. Elements 50 and 52 are spaced from one another and are intended to engage with interlocking elements of the next adjoining panel as will be described hereinafter. It will be noted that interlocking elements 50 and 52 have flat parallel surfaces 54 and 56 which confine therebetween a receptacle, the purpose of which will become apparent hereinbelow.

Panel 14 includes a core 60 of the same material as employed for the core 36. The end or edge portion 62 of this core is flat and parallel and proximate to the end surface 46 of core 38. The upper and lower extremities of the edge portion 62 are recessed as indicated at 64 and 66. This provides shoulders 68 and 70 which cooperatively define a projection or tongue 72. The upper and lower edges of the tongue 72 are chamfered as seen at 74 and 76.

The skins of the core 60 are indicated at 80 and 82. These skins are formed of metal, preferably the same as is used for skins 38 and 40. The skins extend beyond the shoulders 68 and 70 to form interengageable or interlocking elements 84 and 86. Moreover, the extremities 88 and 90 extend beyond surface 62 of tongue or projection 72 in order that the interlocking elements should afford a protection against contact with and damage to the tongue 72. It should be noted at this point that the interlocking elements 50 and 52 as well as the interlocking elements 84 and 86 preferably extend along the entire longitudinal extent (i.e., perpendicular to the plane of the drawing) of the corresponding edges of the associated panels and cores.

Referring now by way of example to interengageable or interlocking element 50, it will be seen that such interlocking element includes a first part or section 100 which extends perpendicularly to the plane 34 and furthermore extends along the face 46 of the core 36. To section 100 is connected a cantilever section or part 102 to the extremity of which is connected a sloped cantilever arm 104 having a lip 106. The lip 106 is parallel to and spaced from the first section 100. The angle which the cantilever arm 104 makes with the cantilever 102 is in the range of 25° to 40° which angular relationship is mentioned by way of preferred example only. Between these two sections results a hinge 110 which enables the ramp 104 to be depressed and to spring back into its illustrated position.

The interlocking or interengageable element 84 which is next described by way of example includes a first section 114 which extends beyond the shoulder 68. A second section 116 is connected orthogonally to section 114 and a lip 118 is connected at right angles to the section 120. Sections 114, 116 and 120 constitute a first J-shaped part extending inwardly of the outer skin of the associated panel. Sections 116, 120 and 118 constitute a second J-shaped section which is hook-shaped. By reason of its length and connection to the remainder of the panel, section 114 is a resilient cantilever member which supports the first J-shaped section to ride up the cantilever arm 104 and to snap into the receptacle 122 of interlocking element 50 as will be discussed hereinbelow. At the same time, the similar cantilever arm in interlocking element 52 as well as the J-shaped section of interlocking element 86 cooperate in the same manner. It will be noted that the tongue 72 is intended to slip into the receptacle or cavity defined between surfaces 54 and 56 and that the adjoining panels are intended to be interconnected by a movement indicated by the double-headed arrow 130.

Figure 3:
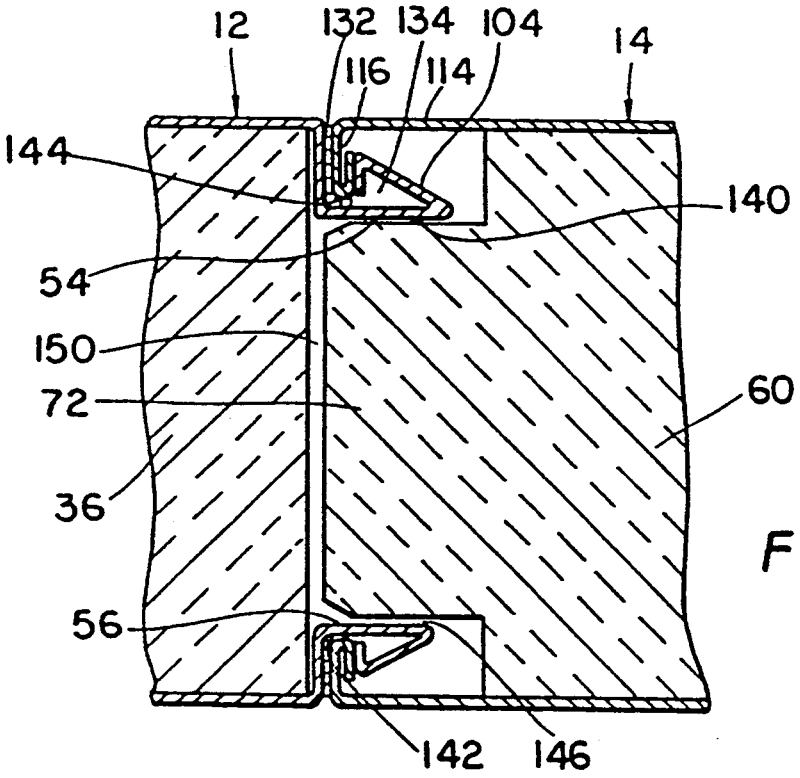
FIG. 3 is a view corresponding to FIG. 2 illustrating adjacent cores or panels in connected relationship.

Referring next to FIG. 3, it is seen that panels 12 and 14 are intended to be brought into the interengaged relationship discussed hereinabove. First, it will be noted that cantilever arm 104 has accommodated the insertion of section 116 as well as the sections connected thereto into the passage or pocket 122 (FIG. 2) by accommodation due to the resilient nature of section 114 and by the slope of cantilever arm 104. Before this interengagement takes place, there is applied to the outer surface of section 100, a silicone sealing caulk indicated at 132. This intervenes between the facing surfaces of sections 116 and 100 (FIG. 2) and provides for a sealed relationship thereat. This in turn seals off the passage 134 which constitutes a hydraulic or fluid drainage passage extending the length of the associated panel for a purpose to become more apparent hereinbelow. It should be noted, however, that this passage is intended for the removal of condensation or leakage or other fluids which might otherwise accumulate and do damage to the respective cores 36 and 60.

Contact or bearing areas are indicated in FIG. 3 at 140 and 142. A further bearing area is indicated at 144 and 146. While the surfaces adjoining bearing areas 140 and 146 are shown in somewhat spaced relationship, this is for purposes of illustration only. In practice, the facing surfaces will ordinarily be in contacting relationship.

It will be noted that the tongue 72, while penetrating between sections 54 and 56, does not penetrate sufficiently to engage with core 36. In fact, there is a space 150 between the tongue and core such that the tongue does not penetrate into the core or, in other words, is short of the same. The interlocking elements therefore define for receiving the tongue, a receptacle which extends the length of the associated panel. Engagement of the tongue, which is a substantially rectilinear rib, is by virtue of the motion indicated in FIG. 2 by arrow 130.

Figure 4:
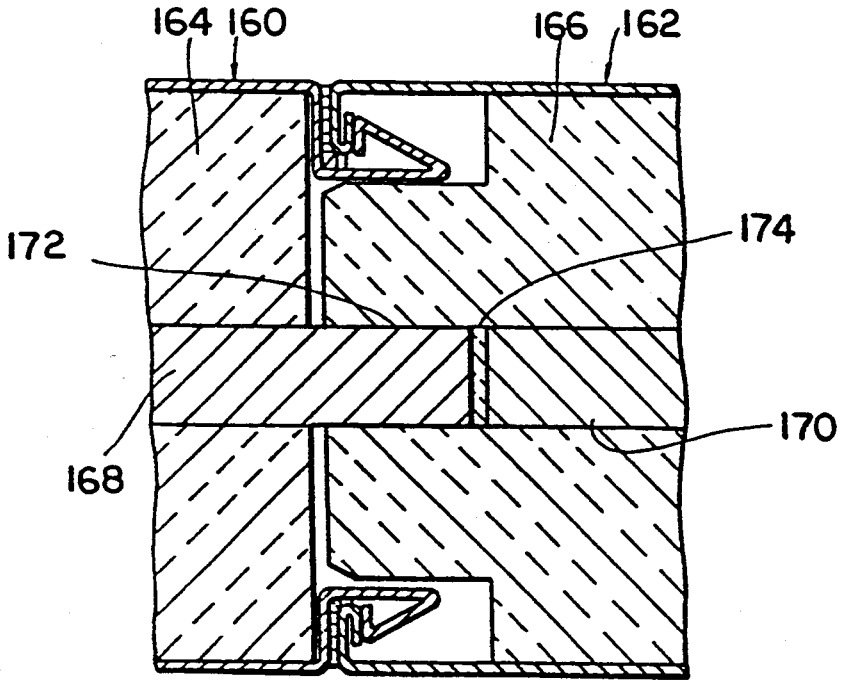
FIG. 4 is a view corresponding to FIG. 3 illustrating a further embodiment of the invention.

In FIG. 4 are illustrated panels 160 and 162, the parts of which are essentially what has been described above relative to FIGS. 2 and 3. In this embodiment of the invention, however, there are embedded, in the respective cores 164 and 166, sheets 168 and 170 of sheetrock. In this arrangement, sheet 168 extends beyond the edge of core 164 to provide a projecting section 172. Sheet 170 is, however, withdrawn from the edge of core 166 in order to define a slot 174. Projection 172 extends into the slot 174 thereby to provide a further interlocking between the panels. This arrangement of sheetrock is moreover intended to facilitate meeting fire-rating requirements for various building codes. In such arrangement, the cores 164 and 166 can be provided in separate sections to accommodate the embedding of the sheets 168 and 170. It is possible, however, to make the sheets 168 and 170 of lesser longitudinal extent than cores 164 and 166 so that separate sections for the respective cores will not be necessary.

Figure 5:
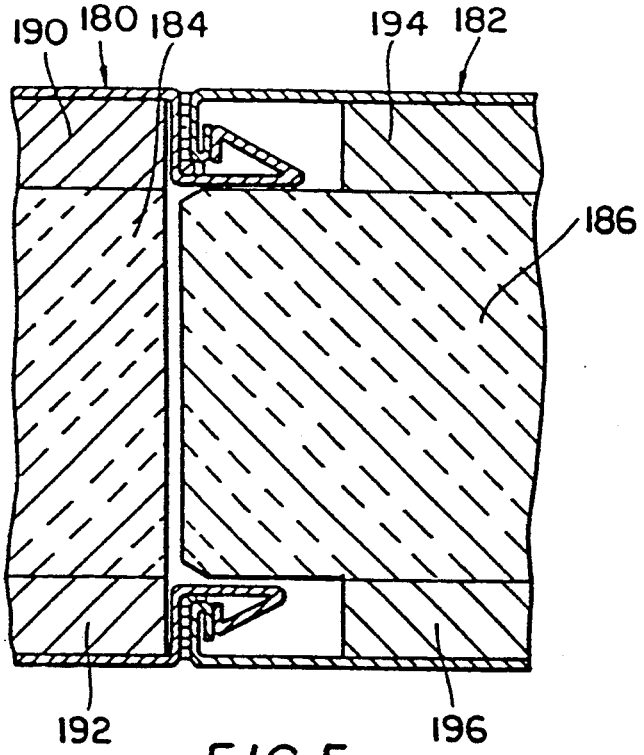
FIG. 5 is a view corresponding to FIG. 4 illustrating still a further embodiment of the invention.

In FIG. 5 are illustrated panels 180 and 182 which are of a construction similar to that indicated above. In this embodiment of the invention, however, the cores 184 and 186 are sandwiched between sheets 190, 192, 194 and 196. These sheets are of sheetrock having the requisite fire-rating requirements for the reasons mentioned hereinabove.

Figure 6:
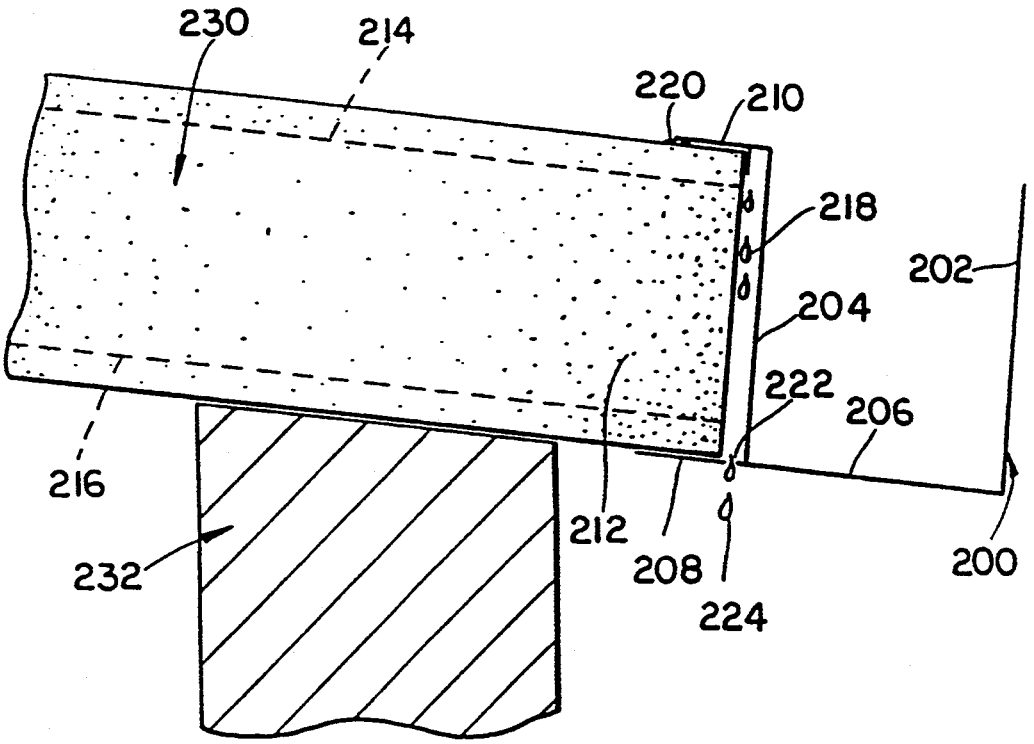
FIG. 6 is a partially sectional partially diagrammatical view illustrating a gutter arrangement for the evacuation of fluid.
Figure 7:
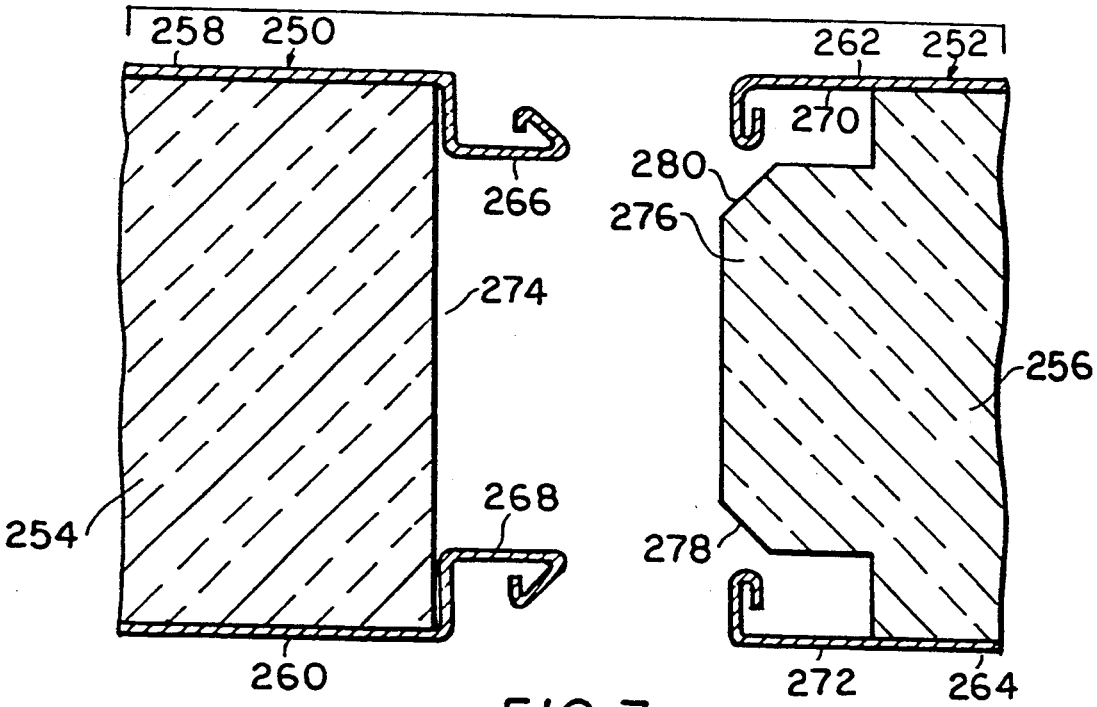
FIG. 7 illustrates adjoining edges of adjacent panels according to a further embodiment of the invention.

FIG. 6 illustrates a further feature of the invention wherein a gutter 200 consisting of sides 202 and 204 connected by bottom 206 is employed for the evacuation of fluid such as water. The gutter 200 is provided with flanges 208 and 210 which are intended to embrace the ends 212 of a series of panels such as has been mentioned hereinabove. These panels are provided with drainage channels shown diagrammatically by way of example at 214 and 216. As a result of these channels, there may be a seepage of water such as indicated at 218. Caulking may be provided between the flanges and the panels. Such caulking is shown by way of example at 220. The flanges may be provided with openings 222 to enable the escape of fluid as shown at 224. These holes constitute means to drain any water accumulated in the drainage channel as illustrated. It will be noted that, in the illustration of this feature, the panel assembly constitute a roof generally indicated at 230 supported on a wall indicated generally at 232. It should be noted that the gutter 200 can readily be fabricated of a plastic having suitable strength or of a sheet metal as preferred.

FIGS. 7–10 illustrate a further embodiment of the invention. Therein appear panels 250 and 252 including cores 254 and 256 respectively. Panel 250 is provided with skins 258 and 260 whereas panel 252 is provided with skins 262 and 264. As described hereinabove, these skins are formed as interlocking elements 266, 268, 270 and 272. Interlocking elements 266 and 268 are provided in spaced relationship so as to define a receptacle 274. The edge of core 256 is provided with tongue 276. This tongue is provided with chamfered edges 278 and 280. Tongue 276 is adapted for accommodation within receptacle 274 between interlocking elements 266 and 268. As in the previously described embodiment, this accommodation of tongue 276 is preferably such as to avoid contact between tongue 276 and the core 254.

Figure 8:
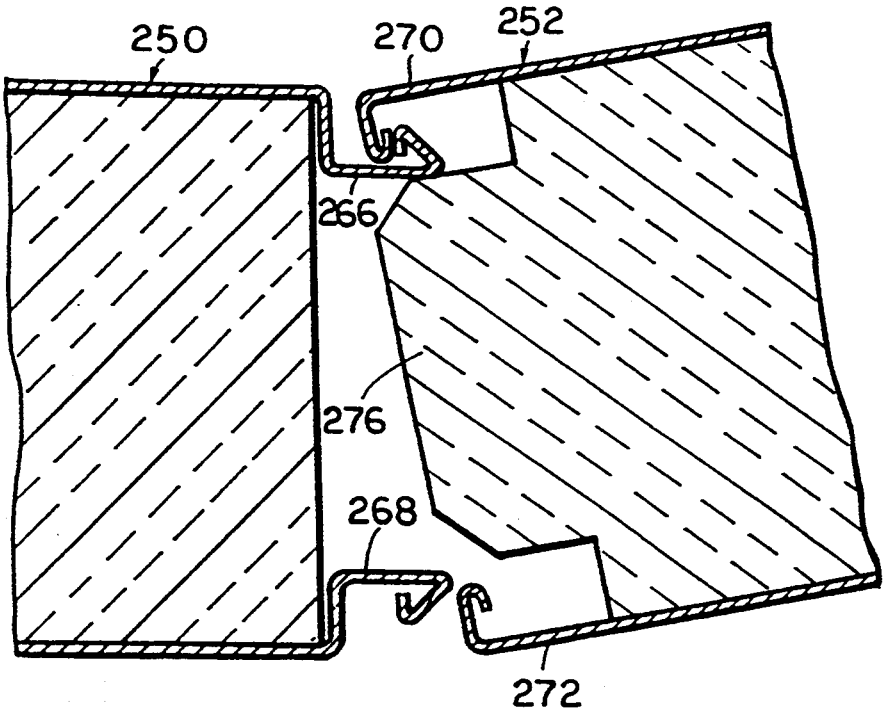
FIG. 8 illustrates the angular relationship of the panels of FIG. 7 upon being brought together.
Figure 9:
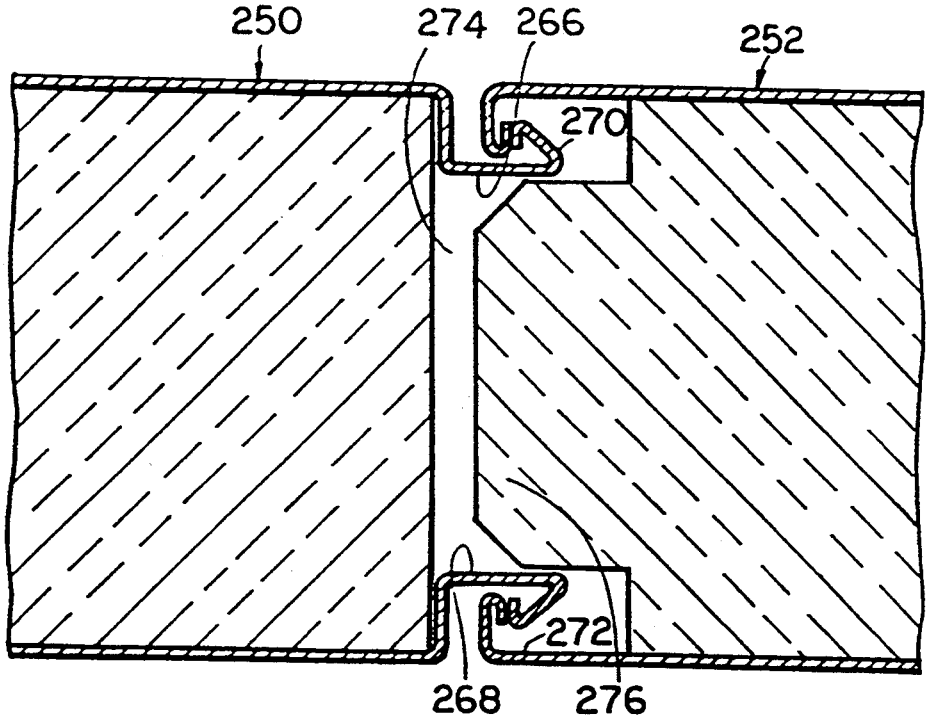
FIG. 9 illustrates the engagement of the panels of FIGS. 7 & 8.
Figure 10:
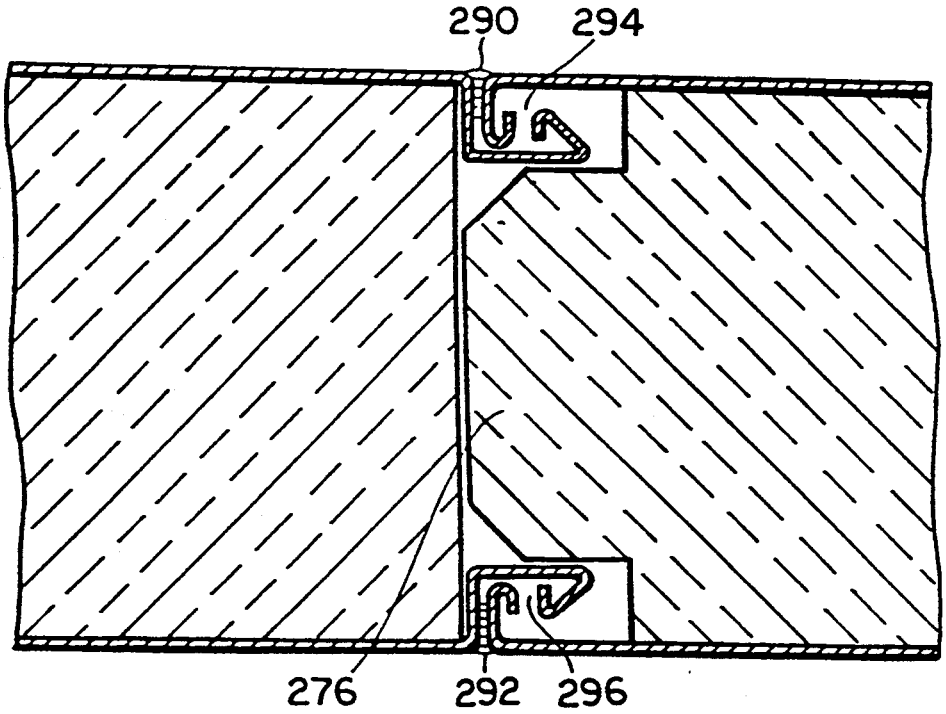
FIG. 10 illustrates the panels of FIGS. 7–9 in engaged and caulked relation.

The purpose of providing the chamfers on core tongue 276 appears more clearly in FIG. 8. It enables the panels 250 and 252 to be brought together in an angular relationship wherein the interlocking elements 266 and 270 can be brought together initially followed by a coupling of the interlocking elements 268 and 272. The latter connection is illustrated more specifically in FIG. 9 wherein the tongue 276 is inserted to nearly full extent in the receptacle 274 with all of the interlocking elements engaged with one another. Thereafter, as appears in FIG. 10, a caulking is inserted as appears at 290 and 292 thereby to seal in drainage channels 294 and 296. Although some spacing is shown between the tongue 276 and the interlocking elements, this is for illustration purposes only as it is preferred that interlocking elements be brought to bear against the tongue thereby to enable the panels to be held in aligned,relationship with one another.

Figure 11:
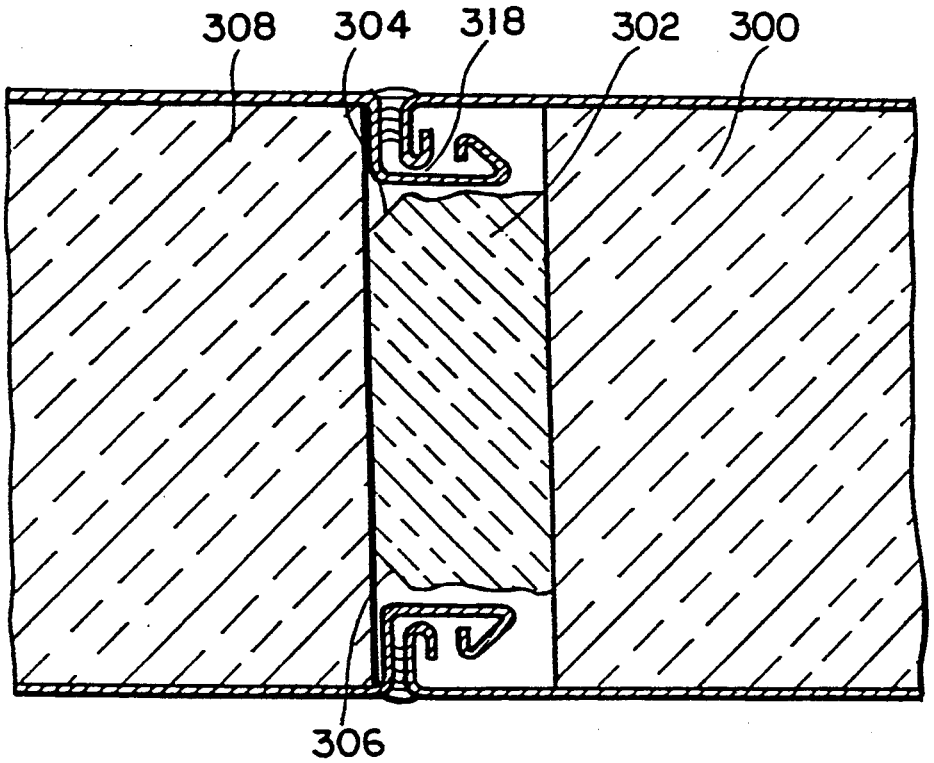
FIG. 11 illustrates a modification of FIG. 10.

In the embodiment of the invention illustrated in FIGS. 7–10, the tongue is shown as being integral with the associated core. In a preferred relationship, the tongue is fabricated separately of the associated core as appears in FIG. 11. In FIG. 11 appears core 300 and tongue 302. The tongue 302 is fabricated separately from the core 300 but is cemented thereto prior to the assembling of the panels. The core and its tongue are fabricated of a sponge-like material such as a polyurethane ether such as fabricated by HO Products Corp. of Wynsted, Conn. The tongue 302 is provided with chamfered edges 304 and 306 to enable the panels to be assembled as has been described hereinabove. It will be noted that the tongue 302 is illustrated as being connected by cement or other such adhesive to the core 300. It is equally possible for the core 302 to be cemented instead to the core 308. For purposes of illustration, there is shown a space at 318. Preferably however, the interlocking elements bottom out against one another and against the associated tongue to provide for the most advantageous relationship.

Figure 12:
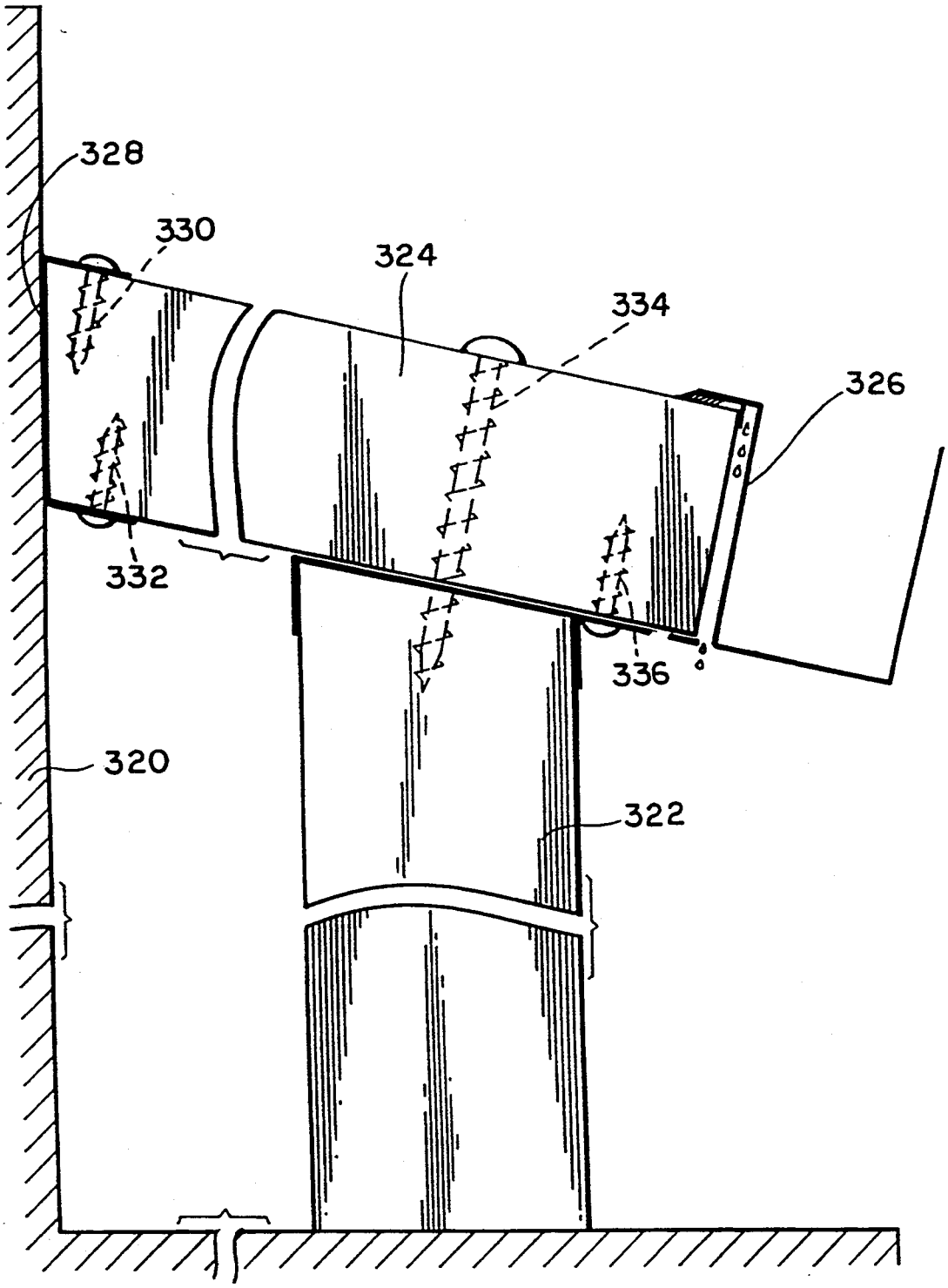
FIG. 12 is a partially broken away view, partly in section, illustrating the attachment of panels to a vertical support.

FIG. 12 illustrates a wall 320 and a front structure 322 spaced therefrom. A plurality of panels 324 are connected with one another and provided with a drain 326 such as has been described hereinabove. The panels may be supported by the wall 320 by the utilization of a C channel 328. Screws such as, for example, shown at 330 and 332 may be inserted into the panels through appropriate holes provided in the C channel 328 in order to retain the panels in aligned relationship firmly affixed to the support 320. Additional screws may be utilized such as illustrated at 334 and 336.

Figure 13:
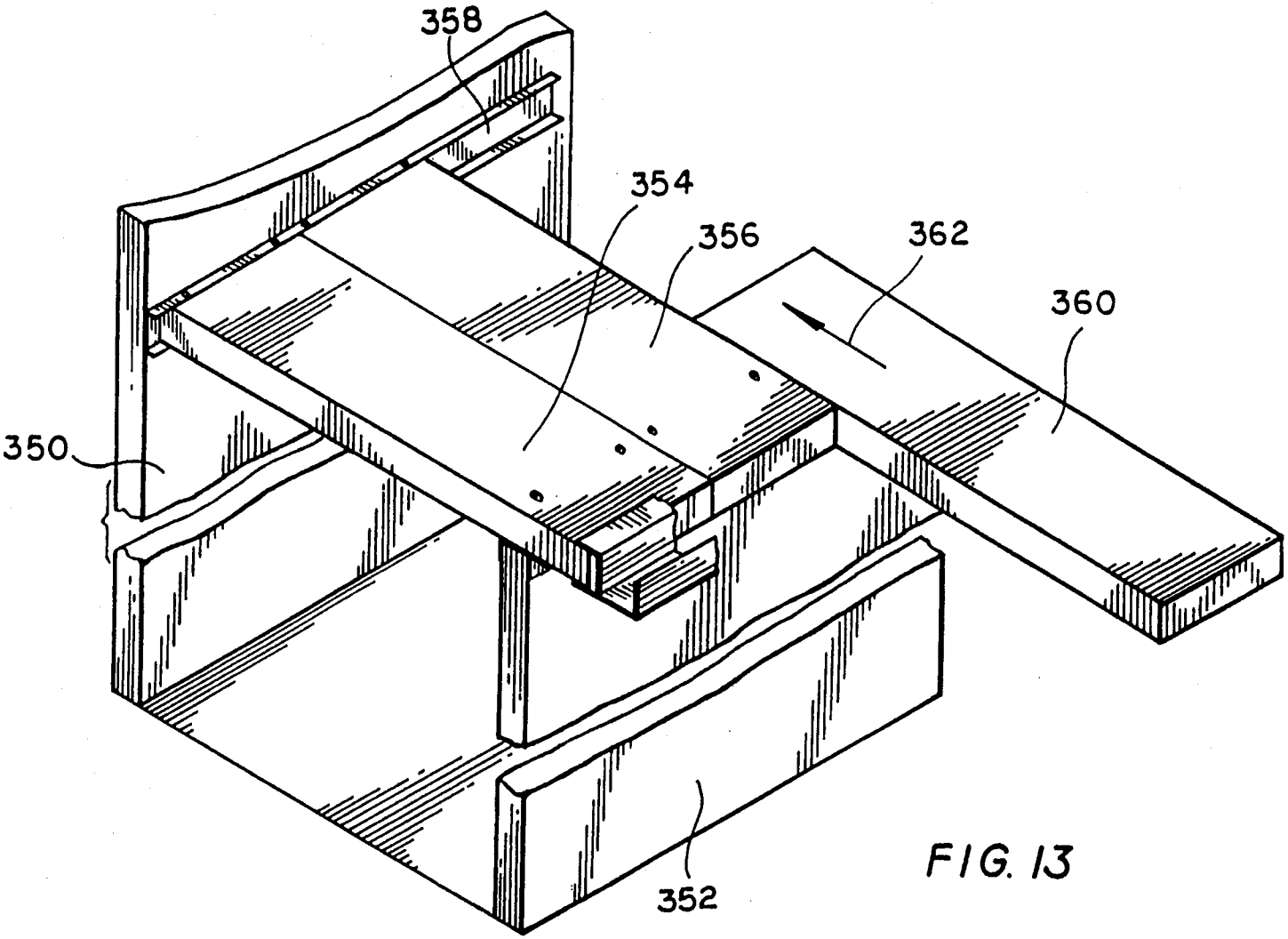
FIG. 13 is a perspective, diagrammatic view further illustrating a multiple-panel assembly technique of the invention.

FIG. 13 illustrates support wall 350 with front wall 352 spaced therefrom. A plurality of panels are illustrated, for example, at 354 and 356, these being accommodated in the C channel 358. In the illustrated embodiment, a further panel 360 is illustrated as being coupled with the panel 356 in edge-to-edge relationship by relative longitudinal displacement between the same as a consequence of which the interlocking elements are engaged with each other. The relative longitudinal displacement is indicated by the arrow 362.

According to the method of the invention, there are comprised the steps of sandwiching each of a plurality of cores between respective pairs of skins, while extending said skins beyond the cores and forming interlocking elements thereat. The elements are interlocked together to connect the cores. Selected interlocking elements are spaced from each other to form a receptacle. A tongue is formed on one of the cores to be received in the receptacle. It will noted hereinabove that the tongue can be separate from but cemented to the associated core. It will also be noted that the tongue is preferably chamfered to permit the interlocking of said elements by tilting said cores relative to one another. The cores may also, as has been noted hereinabove, be brought together directly in edge to edge direction.

According to still another embodiment of the invention as has been discussed above, the interlocking elements can be brought together by relative longitudinal displacement. The interlocking elements themselves are brought together by camming displacement such as has been noted hereinabove relative, for example, to the sloped section 104 (see FIG. 3).

In addition to the foregoing, it has been noted that the method comprises interlocking elements in such a manner as to constitute drainage channels. A further step in the method of the invention involves inserting caulking between selected of the interlocking elements.

There will now be obvious to those skilled in the art many modifications and variations of the structures and methods set forth hereinabove. These modifications and variations will not depart from the scope of the invention if defined by the following claims or the functional equivalents of what is defined.

What is claimed is:

1. A construction comprising first and second panels having first and second faces and including facing edge portions, and pairs of interengaged locking means on said panels at said edge portions and associated with respective ones of said faces; one of the interengaged locking means of each said pair including a first section extending along the corresponding edge portion of the associated panel, a second section extending from the first section in cantilever relation thereto, a cantilever arm section extending angularly from the second section, and a lip extending from the cantilever arm section in substantially spaced parallel relation with said first section; the other of the interengaged locking means of each said pair including a first part aligned in parallel with said second section, a second part extending orthogonally from said first part and parallel to said first section, a third part extending orthogonally from said second part in spaced parallel relation to said first part, said first, second and third parts constituting a first J-shaped structure, and a lip extending from said third part in spaced parallel relation with said second part, the latter said lip, second part and third part constituting a second J-shaped structure, the first J-shaped structure extending between the first section and lip on the cantilever arm section with the lip on the third part in face-to-face relation with the lip on the cantilever arm section; and sealing means between the first section and second part to seal the interengaged locking means hydraulically.

2. A construction as claimed in claim 1 wherein the cantilever arm section, the lip on the cantilever arm section, the second section and the sealing means at least partly define a channel between the panels for the evacuation of water.

3. A construction as claimed in claim 1 wherein the sealing means is a caulk.

4. A construction as claimed in claim 3 wherein the caulk is a silicone sealant.

5. A construction as claimed in claim 1 wherein said panels include respective cores and skins on said cores constituting said faces, said skins including edges constituting said locking means which are interengageable to hold the panels together and which constitute said interengaged locking means, an extension on the core of one of said panels, the locking means on one edge of each of the panels being spaced from one another and defining a receptacle to receive and accommodate the extension short of penetration into the core of said other panel.

6. A construction as claimed in claim 5 wherein the panels are elongated parallel members and said extensions and receptacles extend longitudinally therealong.

7. A construction as claimed in claim 5 wherein the locking members of said other panel define a receptacle with flat parallel sides, the extension having flat parallel sides for sliding insertion into the receptacle.

8. A construction as claimed in claim 5 wherein contact of the extension of each said panel against the core of the next adjacent said panel is prevented by engagement of said locking members such that each said extension is held in spaced relation to the core of the next adjacent panel.

9. A construction as claimed in claim 5 wherein the faces are parallel.

10. A construction as claimed in claim 5 wherein said extension includes chamfered edges to permit a tilting engagement of adjacent panels.

11. A construction as claimed in claim 5 wherein said extension is separate in physical construction from but connected to said core.

12. A construction as claimed in claim 5 comprising sheets of fire resistant material sandwiching said cores.

13. A construction as claimed in claim 5 comprising sheets of fire resistant material embedded in said cores.

14. A construction as claimed in claim 11 comprising a bonding material connecting the extension to the core.

* * * * *